United States Patent [19]

Sédat

[11] 4,447,278

[45] May 8, 1984

[54] CASTABLE PYROTECHNIC COMPOSITION WITH A CHLORINATED BINDER

[75] Inventor: Georges A. Sédat, St.-Raphael, France

[73] Assignee: Etat Francais, France

[21] Appl. No.: 402,076

[22] Filed: Jul. 26, 1982

[30] Foreign Application Priority Data

Aug. 10, 1981 [FR] France ..... 81 15468

[51] Int. Cl.[3] ..... C06B 45/10

[52] U.S. Cl. ..... 149/19.91; 149/19.92; 149/20; 149/116; 149/117

[58] Field of Search ..... 149/19.91, 20, 19.92, 149/116, 117

[56] References Cited

U.S. PATENT DOCUMENTS

| | | | |
|---|---|---|---|
| 3,246,053 | 4/1966 | Kuntz et al. | 149/19.92 |
| 3,520,742 | 7/1970 | Witz | 149/19.91 |
| 3,724,382 | 4/1973 | Zilcosky | 149/19.91 |
| 3,728,172 | 4/1973 | Dillehay et al. | 149/19.92 |
| 3,761,329 | 9/1973 | Zilcosky | 149/19.91 |
| 4,376,001 | 3/1983 | Krone et al. | 149/19.9 |

FOREIGN PATENT DOCUMENTS

| | | | |
|---|---|---|---|
| 2451701 | 5/1976 | Fed. Rep. of Germany | 149/19.91 |
| 2154213 | 5/1973 | France | 149/19.91 |

*Primary Examiner*—Edward A. Miller

*Attorney, Agent, or Firm*—Parkhurst & Oliff

[57] ABSTRACT

The subject of the invention is a castable pyrotechnic composition of the type producing smoke with a colored or colorless flame comprising in particular an oxidation-reduction pair and a chlorinated binder. The binder is a high chlorine content resin. It is constituted by the association of a polymerizable chlorinated monomer with a copolymerized or non-copolymerized chlorinated polymer, the resulting mixture being subjected to polymerization at a moderate temperature, said binder then containing 30 to 70% by weight of chlorine.

11 Claims, No Drawings

CASTABLE PYROTECHNIC COMPOSITION WITH A CHLORINATED BINDER

The technical sector of the present invention is that of castable smoke-producing pyrotechnic compositions with a colored or colorless flame in which the binder is a high chlorine content resin.

Most of the known pyrotechnic compositions producing a white smoke or a colored flame are mixtures of powdered or granulated constituents, consolidated by compression at a high pressure with a small proportion of agglomerating binder.

It is also known that it is possible to obtain a white smoke or a coloured flame by using a chlorine donor substance, generally a chlorinated organic compound with a high chlorine content, the role of which is to form abundant amounts of sublimable metal chlorides, designed to produce either a white (or gray) smoke, or a flame coloration.

Thus, U.S. Pat. No. 2,939,779 describes a composition of the type in which the chlorine donor is hexachloroethane; a low percentage of plastic binder, less than 10%, ensures the cohesion of the whole. Compositions of this type give rise to risks of the charge being fragmented by impacts during its utilization. On the other hand, during prolonged storage, their permeability to moisture alters their characteristics and makes them unable to operate correctly.

The utilization of polyvinyl chloride in a pyrotechnic composition is proposed in U.S. Pat. No. 2,997,375. It has never been actually possible to use this type of composition because since these chlorinated resins are thermoplastic, metal perchlorates must be used exclusively, which is hazardous in industrial production.

A pyrotechnic composition containing polyvinyl chloride and possibly an additional chlorine donor consisting of an ammonium chloride type salt has further been suggested in French Pat. No. 2 153 431. The polyvinyl chloride must be dissolved in a plasticizer, but in that case, the acceptable proportion of plasticizers hardly exceeds 15% by weight of the total composition. Above this value, the plasticizer acts excessively as a dilutant and the performance of the composition are reduced accordingly. Thus, since the plasticizer is the only liquid constituent of the composition, its small percentage renders the mixing and castability of this composition problematic.

As regards P.V.C., its proportion can hardly exceed 15 to 16% without causing a reduction in the percentages of active ingredients (oxidant and zinc oxide), which would prejudice the operation and the effect required. Thus, the binder obtained is relatively poor in halogen (30% of the total binder and 10% of the composition), whereas the optimum efficiency of the composition requires about 30% by weight of the composition of which 12 to 13% are accounted for by the oxidizing perchlorate (ammonium perchlorate), the remainder having to be supplied by the binder. In addition, the "setting" of this binder requires "curing" for several hours at about 150° C., a temperature which is too high for a pyrotechnic composition which begins to react from about 200° C. The hazards in manufacture are therefore great.

The object of the present invention is to provide an improved smoke reducing pyrotechnic composition and a new pyrotechnic composition with a colored flame, the operating temperature of which can be adjusted according to needs to between 350° C. and 500° C. to produce smoke with flameless combustion, up to 1000° C. or more to produce combustion with a colored flame.

Another object of the present invention is to provide a new pyrotechnic composition which not only produces smoke or a colored flame but also is easy to mix and cast (or extrude) at either ordinary temperatures or at about 0° C. in order to obtain a resin by polymerization, a charge of great compactness and great structural cohesion that avoids fragmentation by impacts or vibrations.

Still another object of the invention is to provide a pyrotechnic composition not containing any solvent at all, which later would impair its storage properties by undesirably altering its pyrotechnic behavior over time, and undesirably altering its suitability for casting into various shapes and sizes.

Yet another object of the invention is to provide a pyrotechnic composition in which the binder, in addition to acting as a charge consolidant and combustion regulator is an abundant donor of the chlorine required to obtain the desired effect; this halogen can constitute at least 30% and up to 70% by weight of the binder.

Yet another object of the invention is to provide a pyrotechnic composition whose binder can be hardened by polymerization at the ordinary temperature or at a slightly raised temperature not exceeding a maximum of 80° C.

The subject of the invention is therefore a castable pyrotechnic composition comprising an oxidation-reduction pair and a chlorinated binder, wherein the binder consists in an association of polymerizable chlorinated monomer and a copolymerized or non copolymerized chlorinated polymer. The resulting mixture being subjected to polymerization at a moderate temperature, said binder containing about 30 to 70% by weight of chlorine.

The monomer can be a chlorinated alkylene in which the number of carbon atoms is between 2 and 5, the chlorinated polymer being of the perchlorinated type.

The chlorinated alkylene can be 1,1 dichloro-ethylene and the chlorinated polymer perchlorinated polyprpoylene or polyethylene.

The binder can include 50 to 80% by weight of chlorinated monomer, the remainder consisting of the chlorinated polymer.

The binder can advantageously include about 70% of chlorinated monomer and 30% of chlorinated polymer.

The binder can also include about 50 to 60% by weight of chlorinated monomer, 20 to 25% by weight of chlorinated polymer and 15 to 20% by weight of another monomer such as allyldiglycol carbonate.

The binder can comprise in addition an organic peroxide type hardener in a proportion of about 3 to 4% of the total weight of the binder.

Applied to the production of smoke, the pyrotechnic composition can comprise about 30 to 35% by weight of zinc oxide, 25 to 35% by weight of ammonium perchlorate and 30 to 40% by weight of binder.

Applied to the production of smoke with a colored flame, the pyrotechnic composition can comprise about 40 to 60% of ammonium, strontium or barium nitrate or perchlorate, 10 to 20% by weight of a heat generating agent chosen from the group constituted by magnesium, boron, calcium disilicide, 30 to 40% by weight of binder.

The pyrotechnic compositions according to the invention can include a plasticizer chosen for example in the family of phthalic esters, in a small proportion.

As indicated previously, the association of a chlorinated polymer, belonging to a family known under the name of chlorinated rubbers, surprisingly produces a binder or a resin that can be used in pyrotechnic compositions, whose mechanical strength is considerably improved and makes it suitable for consolidating a charge with minimum shrinkage. Of course, the binder must be added in sufficient quantity.

Within the scope of the invention the best results are obtained with 1,1 dichloro-ethylene.

1,1 dichloro-ethylene or vinylidene chloride is a very mobile liquid, with a low boiling point (31.6° C. at normal pressure). Used as such it is not very suitable for obtaining a castable composition as its viscosity is practically nil and for this reason does not act as a lubricant for the solid particles during the preparation of the composition. In addition, bulk polymerization of the monomer alone gives a friable and fissured polymer that experiences considerable shrinkage and retains mechanical properties which make this product unsuitable as a charge consolidant, if polymerization takes place at atmospheric pressure. The desired viscosity is then obtained by dissolving in the monomer the soluble chlorinated polymer such as perchlorinated polypropylene or polyethylene, more generally a compound of the "chlorinated rubbers" family.

The mixture of vinylidene chloride and perchlorinated polymer is obtained in the preferred proportion of 70% by weight of the monomer and 30% of the polymer. Hardening is obtained by dissolving in the resin a suitable proportion, about 3 to 4%, of hardener of the organic peroxide type, such as benzoyl peroxide or better isopropyl or butyl-cyclohexyl percarbonate. The constituents of the pyrotechnic charge, such as nitrates, perchlorates, metal oxides, metal in powder form, are incorporated in the liquid resin at a temperature below 20° C., if possible about 10° C., the whole being mixed for a few moments and then cast into molds.

The hardening of the composition is obtained at ordinary temperatures, about 20 to 25° C., in a sealed cover or under a protective liquid layer in order to avoid appreciable loss of monomer by evaporation.

In this way a solid, compact pyrotechnic composition is obtained, the binder of which is a high chlorine content resin, containing about 70% of this halogen.

The binder thereby obtained can be modified in its composition in various ways in accordance with the effect required. Thus, the resin may be required to be modified to increase consolidation and to adjust the combustion speed of the composition. Such modification can comprise: adding to the resin before hardening, another conventional resin compatible with the resin in order to obtain copolymerization. A low viscosity liquid monomer such as allyldiglycol carbonate, may be used for the preparation of this conventional resin.

This monomer is completely soluble and compatible with the chlorinated resin and hardens with the same catalyst. The desired percentage of this monomer is 15 to 20% of the weight of the total resin, but the amount of desired monomer can vary beyond these limits.

With 20% of this monomer, the halogen content is about 56% or essentially equivalent to pure polyvinyl chloride. Another reason for using this monomer is its high oxygen content (41%) which advantageously limits the excess of the reduction agent which often impairs the desired effect. It should be noted that other resins can be substituted for this monomer.

In the case of the modified resin, polymerization occurs under the same conditions at the same temperature. However, it may be desired to improve hardening by terminating the polymerization phase at an appreciably higher temperature, from 30 to 80° C. for a duration of 2 to 4 hours.

The chlorinated monomer can also be partially replaced by a plasticizer of the substituted phthalic esters family compatible with the resin. For instance, butylglycol phthalate is compatible with chlorinated rubbers, it imparts to the hardened composition a more elastic consistency that both avoids breakage on violent impact, and makes it possible to create charges without using a casing.

Thus, the modified resin has the following preferred composition:

vinylidene chloride 55%
perchlorinated propylene or perchlorinated polyethylene 23.5%
allyldiglycol carbonate 18.5%
catalyst (organic peroxide) 3%.

One method for preparing the binder comprises: a catalyst is added to the vinylidene dichloride at a temperature between 0° C. and 10° C. with slight stirring. Dissolution immediately occurs. The chlorinated polymer is then added while stirring. Dissolution is rapid at the beginning but becomes increasingly slow as the viscosity of the solution increases. After complete dissolution, the second monomer is added, if necessary while stirring. Dissolution again, is practically immediate.

This resin can thus be kept, ready for further use by keeping it refrigerated for several weeks at a temperature less than 0° C. or in the alternative it can be kept for a few days at a temperature between 0° C. and 10° C.

The chlorine content of this resin is about 56% by weight or equivalent to the pure polyvinyl chloride.

A few examples of the utilization of the resin described above for the preparation of castable pyrotechnic composition will be given by way of illustration.

The solid constituents, nitrates, perchlorates, and oxides are ground and passed through a 0.2 mm sieve and cooled with the metal powder, in the desired case, with aluminum. These constituents are introduced into the resin at a temperature less than or equal to 10° C. while mixing. The resulting composition is then cooled.

Polymerization is allowed to take place at an ambient temperature (20° C.) for 24 hours ending with 8 hours of polymerization at a higher temperature, 25° C., and 4 hours at 30° C. The mechanical strength of the charge can be improved by terminating the operation by storing at 50 to 70° C. for a few hours, but this is not essential if simple hardening is sufficient.

The volatility of the chlorinated monomer, although its vapour pressure is reduced by dilution, is nevertheless considerable and requires the container to be sealed, otherwise a 5 to 15 mm thick layer of solution, sparingly soluble in the resin, is poured onto the case composition leaving an imperious plastic film with evaporation. The desired embodiment utilizes an acetone solution of polyvinyl nitrate but other solutions such as polyvinyl chloroacetate in solution and ethyl acetate can be used.

EXAMPLE I

A white smoke composition consists of 32% of ammonium perchlorate, 32% of zinc oxide and 36% of resin; 200 g of this composition are cast in a cylindrical aluminum casing having a diameter of 55 mm.

This composition initiated by a conventional ignition composition (or directly with the flame of a match), burns without flame for 30 seconds producing an abundant very opaque white smoke.

EXAMPLE II

A composition producing a red flame comprising 54% of strontium nitrate, 12% magnesium, 35% resin. 100 g of this composition when loaded into an aluminum tube 32 mm in diameter burns for 50 seconds with a red flame.

EXAMPLE III

A composition producing a green flame comprising of 55% barium nitrate, 12% magnesium and 33% of resin. 100 g of this composition when placed in an aluminum tube of 32 mm in diameter burns for 50 seconds with a green flame.

EXAMPLE IV

A composition producing a green flame comprising 15% of barium perchlorate, 40% of barium nitrate, 12% magnesium, 33% resin. 100 g of this composition inserted into an aluminum tube of 32 mm in diameter burns for 40 seconds with a green flame.

EXAMPLE V

A composition producing a red flame comprising 46% of strontium nitrate, 16% of calcium disilicite and 32% of chlorinated resin. 100 g of this composition burns with a very red flame.

I claim:

1. A castable pyrotechnic composition such as a smoke composition or flare composition comprising oxidizing and reducing pyrotechnic ingredients and a chlorinated binder, said binder comprising a polymerizable chlorinated monomer and a copolymerized or non-copolymerized chlorinated polymer.

2. A castable pyrotechnic of claim 1, wherein said monomer is a chlorinated alkylene in which the number of carbon atoms is between 2 and 5, and wherein said polymer is a chlorinated rubber.

3. A castable pyrotechnic of claim 2, wherein said rubber is a perchlorinated rubber.

4. A castable pyrotechnic of claim 3, wherein said chlorinated alkylene is 1.1-dichloro-ethylene or vinylidene chloride and said rubber is perchlorinated polypropylene or polyethylene.

5. A castable pyrotechnic as in claim 4 wherein said binder comprises 50 to 80% by weight of said monomer and 20 to 50% by weight of said polymer.

6. A castable pyrotechnic of claim 5 wherein said binder comprises 70% by weight of said chlorinated alkylene and 30% by weight of said rubber.

7. A castable pyrotechnic as in claim 1 wherein said binder further comprises a plasticizer of the phtalic esters family.

8. A castable pyrotechnic as in claim 7 wherein said binder further comprises a second monomer which is allyldiglycol carbonate.

9. A castable pyrotechnic as in claim 7, wherein said binder comprises: 50 to 60% by weight of said polymerizable chlorinated monomer, 20 to 25% by weight of said polymer, 15 to 20% by weight of allyldiglycol carbonate.

10. A method for preparation of a smoke pyrotechnic composition with a chlorinated binder comprising the following steps:

dissolving a catalyst of the organic peroxide family in a polymerizable chlorinated alkylene monomer of 2 to 5 carbon atoms in amount of 50 to 80% by weight at a temperature between 0° C. and 10° C. and, dissolving a copolymerized or non-copolymerized chlorinated polymer in the amount of 20 to 50%, said catalyst being in the amount of 3 to 4% by weight calculated on the total mass of said monomer and said polymer, and mixing 30 to 40% of said binder, with 30 to 35% by weight of zinc oxide, and 20 to 35% by weight of ammonium perchlorate at a temperature under 20° C.

11. A method for preparation of a smoke colored flame composition with a chlorinated binder comprising the following steps:

dissolving a catalyst of the organic peroixde family in a polymerizable chlorinated alkylene monomer of 2 to 5 carbon atoms in amount of 50 to 80% by weight at a temperature between 0° C. and 10° C. and, dissolving a copolymerized or non-copolymerized chlorinated polymer in an amount of 20 to 50% by weight, said catalyst being 3 to 4% by weight calculated on the total mass of said monomer with said polymer, and mixing 30 to 40% by weight of said binder with 40 to 60% of ammonium, strontium or barium nitrate or perchlorate, and with 10 to 20% by weight of a heat generating agent chosen from the group that includes magnesium, boron, calcium disilicide.

* * * * *